US009862027B1

(12) United States Patent
Loehken

(10) Patent No.: US 9,862,027 B1
(45) Date of Patent: Jan. 9, 2018

(54) SHAPED CHARGE LINER, METHOD OF MAKING SAME, AND SHAPED CHARGE INCORPORATING SAME

(71) Applicant: DynaEnergetics GmbH & Co. KG, Troisdorf (DE)

(72) Inventor: Joern Olaf Loehken, Troisdorf (DE)

(73) Assignee: DynaEnergetics GmbH & Co. KG, Troisdorf (DE)

( * ) Notice: Subject to any disclaimer, the term of this patent is extended or adjusted under 35 U.S.C. 154(b) by 0 days.

(21) Appl. No.: 15/499,408

(22) Filed: Apr. 27, 2017

Related U.S. Application Data

(60) Provisional application No. 62/445,672, filed on Jan. 12, 2017, provisional application No. 62/488,182, filed on Apr. 21, 2017.

(51) Int. Cl.

| | |
|---|---|
| ***F42B 1/00*** | (2006.01) |
| ***F42B 1/02*** | (2006.01) |
| ***B22F 1/00*** | (2006.01) |
| ***B22F 3/06*** | (2006.01) |
| ***B22F 3/093*** | (2006.01) |
| ***B22F 3/16*** | (2006.01) |

(Continued)

(52) U.S. Cl.
CPC ..... *B22F 1/0011* (2013.01); *B22F 3/06* (2013.01); *B22F 3/093* (2013.01); *B22F 3/16* (2013.01); *B22F 5/106* (2013.01); *E21B 43/117* (2013.01); *F42B 1/032* (2013.01)

(58) Field of Classification Search
CPC ..... B22F 1/0011; B22F 5/106; E21B 43/117; F42B 1/032
USPC ..... 102/306, 307
See application file for complete search history.

(56) References Cited

U.S. PATENT DOCUMENTS 2,650,539 A 9/1953 Greene
3,077,834 A * 2/1963 Caldwell ..... E21B 43/117 102/306

(Continued)

FOREIGN PATENT DOCUMENTS

DE 102005059934 A1 12/2005
EP 1682846 B1 7/2006

(Continued)

OTHER PUBLICATIONS

Hardesty et al., Translation of New Experimental Test Methods of the Evaluation & Design of Shaped Charge Perforators to Field Applications, Jun. 7-10, 2011, 15 pgs, SPE.

(Continued)

*Primary Examiner* — Samir Abdosh
(74) *Attorney, Agent, or Firm* — Lisa J. Moyles; Janelle A. Bailey

(57) ABSTRACT

A shaped charge liner including a composition of powders. The composition may include one or more of an aluminum metal powder and a titanium metal powder, a bronze metal powder, a tungsten metal powder and a graphite powder. Each powder of the composition may include grain size ranges that are different from one or more other powder grain size ranges. The bronze metal powder may include two or more different grain size ranges, and in some instances three or four different grain size ranges. A method of making the shaped charge liner and shaped charge with such liner having the composition of powders is also disclosed, as is a shaped charge including such shaped charge liner.

20 Claims, 6 Drawing Sheets

(51) Int. Cl.

| | |
|---|---|
| ***B22F 5/10*** | (2006.01) |
| ***F42B 1/032*** | (2006.01) |
| ***E21B 43/117*** | (2006.01) |

(56) References Cited

U.S. PATENT DOCUMENTS

| | | | | |
|---|---|---|---|---|
| 3,235,005 | A | 2/1966 | Delacour | |
| 3,375,108 | A | 3/1968 | Wyman, Sr. et al. | |
| 3,675,575 | A | 7/1972 | Bailey et al. | |
| 4,613,370 | A | 9/1986 | Held et al. | |
| 4,766,813 | A | 8/1988 | Winter et al. | |
| 5,083,615 | A | 1/1992 | McLaughlin et al. | |
| 5,098,487 | A | 3/1992 | Brauer et al. | |
| 5,212,343 | A | 5/1993 | Brupbacher et al. | |
| 5,259,317 | A | 11/1993 | Lips | |
| 5,413,048 | A * | 5/1995 | Werner | F42B 1/032 102/307 |
| 5,551,344 | A | 9/1996 | Couet et al. | |
| 5,567,906 | A | 10/1996 | Reese et al. | |
| 5,656,791 | A | 8/1997 | Reese et al. | |
| 5,814,758 | A | 9/1998 | Leidel | |
| 5,859,383 | A | 1/1999 | Davison et al. | |
| 6,349,649 | B1 * | 2/2002 | Jacoby | F42B 1/028 102/306 |
| 6,354,219 | B1 * | 3/2002 | Pratt | E21B 43/117 102/306 |
| 6,354,222 | B1 | 3/2002 | Becker et al. | |
| 6,371,219 | B1 | 4/2002 | Collins et al. | |
| 6,378,438 | B1 | 4/2002 | Lussier et al. | |
| 6,494,139 | B1 | 12/2002 | Powell | |
| 6,564,718 | B2 | 5/2003 | Reese et al. | |
| 6,588,344 | B2 | 7/2003 | Clark et al. | |
| 6,634,300 | B2 | 10/2003 | Reese et al. | |
| 6,655,291 | B2 * | 12/2003 | Pratt | E21B 43/117 102/307 |
| 6,668,726 | B2 | 12/2003 | Lussier | |
| 6,962,634 | B2 | 11/2005 | Nielson et al. | |
| 7,011,027 | B2 | 3/2006 | Reese et al. | |
| 7,036,594 | B2 | 5/2006 | Walton et al. | |
| 7,261,036 | B2 | 8/2007 | Bourne et al. | |
| 7,278,353 | B2 | 10/2007 | Langan et al. | |
| 7,278,354 | B1 | 10/2007 | Langan et al. | |
| 7,393,423 | B2 * | 7/2008 | Liu | C06B 33/00 149/108.2 |
| 7,712,416 | B2 * | 5/2010 | Pratt | F42B 1/028 102/307 |
| 7,721,649 | B2 | 5/2010 | Hetz et al. | |
| 7,749,345 | B2 | 7/2010 | Wood | |
| 7,775,279 | B2 | 8/2010 | Marya et al. | |
| 7,811,354 | B2 | 10/2010 | Leidel et al. | |
| 7,913,758 | B2 | 3/2011 | Wheller et al. | |
| 7,921,778 | B2 | 4/2011 | Stawovy | |
| 7,987,911 | B2 | 8/2011 | Rhodes et al. | |
| 8,037,829 | B1 | 10/2011 | Waddell et al. | |
| 8,075,715 | B2 | 12/2011 | Ashcroft et al. | |
| 8,122,833 | B2 | 2/2012 | Nielson et al. | |
| 8,156,871 | B2 | 4/2012 | Behrmann et al. | |
| 8,220,394 | B2 | 7/2012 | Bates et al. | |
| 8,245,770 | B2 | 8/2012 | Bell et al. | |
| 8,381,652 | B2 | 2/2013 | Glenn | |
| 8,544,563 | B2 | 10/2013 | Bourne et al. | |
| 8,584,772 | B2 | 11/2013 | Yang et al. | |
| 8,701,767 | B2 | 4/2014 | Andrzejak et al. | |
| 8,726,995 | B2 | 5/2014 | Bell et al. | |
| 9,080,431 | B2 | 7/2015 | Bell et al. | |
| 9,080,432 | B2 | 7/2015 | Yang et al. | |
| 9,644,460 | B2 | 5/2017 | Bell et al. | |
| 2002/0112564 | A1 * | 8/2002 | Leidel | C22C 1/045 75/248 |
| 2002/0129726 | A1 * | 9/2002 | Clark | F42B 1/032 102/476 |
| 2003/0037693 | A1 | 2/2003 | Wendt, Jr. et al. | |
| 2003/0131749 | A1 * | 7/2003 | Lussier | F42B 1/028 102/306 |
| 2004/0156736 | A1 | 8/2004 | Ocher et al. | |
| 2005/0100756 | A1 | 5/2005 | Langan et al. | |
| 2005/0115448 | A1 * | 6/2005 | Pratt | F42B 1/032 102/476 |
| 2006/0266551 | A1 | 11/2006 | Yang et al. | |
| 2007/0053785 | A1 * | 3/2007 | Hetz | E21B 43/117 419/42 |
| 2007/0227390 | A1 | 10/2007 | Palmateer | |
| 2008/0282924 | A1 * | 11/2008 | Saenger | E21B 37/08 102/306 |
| 2008/0289529 | A1 | 11/2008 | Schilling | |
| 2009/0078144 | A1 * | 3/2009 | Behrmann | F42B 1/032 102/307 |
| 2009/0235836 | A1 * | 9/2009 | Pratt | F42B 1/032 102/306 |
| 2009/0294176 | A1 * | 12/2009 | Gessel | F42B 1/032 175/57 |
| 2010/0230104 | A1 | 9/2010 | Noelke et al. | |
| 2013/0126238 | A1 | 5/2013 | Church et al. | |
| 2013/0340643 | A1 | 12/2013 | Yang et al. | |
| 2015/0226533 | A1 * | 8/2015 | Grattan | E21B 43/117 102/313 |
| 2015/0376992 | A1 * | 12/2015 | Grattan | E21B 43/117 175/4.57 |

FOREIGN PATENT DOCUMENTS

| | | |
|---|---|---|
| EP | 2320025 A1 | 5/2011 |
| FR | 2749382 A1 | 12/1997 |

OTHER PUBLICATIONS

Geodynamics, Technology/Product Preview, OTC Luncheon Presentation, Apr. 30, 2007, 35 pgs., http://www.perf.com/.

Bell et al., Reactive Perforating: Conventional and Unconventional Applications, Learnings and Opportunities, May 27-29, 2009, 6 pgs., Society of Professional Engineers.

Donaldson et al., Advances in Powder Metallurgy & Particulate Materials-2012, Jun. 10-13, 2012, 13 pgs., Proceedings of the 2012 International Conference, Princeton, NJ, USA.

Hardt, Incendiary Potential of Exothermic Intermetallic Reactions, Jul. 1971, 79 pgs., Air Force Armament Laboratory, Eglin Air Force Base, FL, USA.

Bartz et al., Let's Get the Most Out of Existing Wells, Oilfield Review, Winter 1977, 20 pages.

Universal Filters, Inc., Mesh to Micron Conversion Chart, Oct. 26, 2008, 2 pgs., http://www.universalfilters.com/MMCC.html.

Henz et al., Molecular Dynamics Simulation of the Kinetic Reaction of Nickel and Aluminum Nanoparticles, Mar. 2010, 36 pgs, U.S. Army Research Laboratory, Aberdeen Proving, MD.

Bell et al., New titanium-lined shaped-charge perforator, The Oil and Gas Journal, Nov. 5, 1962, 5 pages.

Bell et al., Next-generation perforating system enhances testing, treatment of fracture stimulated wells, Drilling Contractior, Nov./Dec. 2008, 8 pages.

Fischer et al., A Survey of Combustible Metals, Thermites, and Intermetallics for Pyrotechnic Applications, Sandia National Laboratories, Jul. 1-3, 1996, 15 pgs, Albuquerque,NM.

Behrmann et al., Perforating Practices That Optimize Productivity, Oilfield Review, Spring 2000, 22 pages, perfo.slb.ru/docs/pptop.pdf.

Church et al., Investigation of a Nickel-Aluminum Reactive Shaped Charged Liner, Journal of Applied Mechanics, May 2013, 13 pgs, vol. 80, ASME.

Haggerty et al., A Comparative Assessment of 3 3/8-in. Perforators Using 'Reactive' and 'Non-reactive' Shaped Charges, Sep. 23-25, 2009, 10 pgs, SPE 125752, SPE.

Dynaenergetics, Field experience with the DYNAenergetics DPEX reactive liner charges, Presentation, Oct. 8, 2015, 27 pages.

Dynaenergetics, Don't Miss Out on Improved Perforation! Shaped charges from DYNAenergetics, DPEX Charge Brochure, 4 pages, azul-plus.squarespace.com/s/dyna_dpex_brochure.pdf.

(56) References Cited

OTHER PUBLICATIONS

Mizutani et al, e/a Determination for the transition metal element TM in Al—Cu—TM—Si (TM=Fe&Ru) approximants & B2-compounds by means of the FLAPW-Fourier method, Jun. 2008, 4 pgs.
Massalski et al., ELECTRONTiC Structure of Hume-Rothery Phases, Nov. 15, 1977, 5 pgs., Carnegie-Mellon University, Pittsburgh, PA, USA.
Wade et al., Field Tests Indicate New Perforating Devices Improve Efficiency in Casing Completion Operations, Oct. 1962, 5 pgs., Journal of Petroleum Technology.
Matt Bell, Reactive® Perforating:The New Ballistic Frontier That's Revolutionizing Well Completions, Jul. 16, 2009, 41 pgs., Society of Petroleum Engineers, Bangkok Chapter.
Jacobi et al., Optical Properties of Ternary B Electronphases based on NiAl, J. Phys. Chem. Solids, 1973, vol. 34, 12 pages, Pergamon Press, Great Britain.
Valery Marinov, Powder Metallurgy Process, Manufacturing Technology, Oct. 2000, 4 pgs., http://me.emu.edu.tr/me364/ME364_PM_process.pdf.
Zhang et al., The prediction of solid solubility of alloys: developments and applications of Hume-Rothery's rules, 2010, 40 pgs, J. of Crystallization Physics and Chemistry.
Michael D. Tucker, Characterization of Impact Initiation of Aluminum-Based Intermetallic-Forming Reactive Materials, Thesis, Dec. 2011, 84 pages, Georgia Inst. of Technology.
Mirko Vivus, Reduction of the skin cause by perforation using reactive liner material, Diploma Thesis, Jul. 12, 1971, 82 pgs, Freiberg University of Mining & Technology.
M. Hicks, Metals and alloys. Hume-Rothery rules, Dec. 2003, 31 pages, Shenyang National Lab. for Materials Science, www.synl.ac.cn/org/non/zul/knowledge/Hume-Rothery-rules.pdf.

* cited by examiner

SHAPED CHARGE LINER, METHOD OF MAKING SAME, AND SHAPED CHARGE INCORPORATING SAME

CROSS-REFERENCE TO RELATED APPLICATIONS

This application claims the benefit of U.S. Provisional Application No. 62/445,672, filed Jan. 12, 2017 and U.S. Provisional Application No. 62/488,182, filed Apr. 21, 2017, each which is incorporated herein by reference in its entirety.

FIELD

The present invention relates generally to a shaped charge liner having a composition including metal powders. More specifically, the present invention relates to a shaped charge having a shaped charge liner including a composition of metal powders.

BACKGROUND

As part of a well completion process, cased-holes/wellbores are perforated to allow fluid or gas from rock formations (reservoir zones) to flow into the wellbore. Perforating gun string assemblies are conveyed into vertical, deviated or horizontal wellbores, which may include cemented-in casing pipes and other tubulars, by slickline, wireline or tubing conveyance perforating (TCP) mechanisms, and the perforating guns are fired to create openings/perforations in the casings and/or liners, as well as in surrounding formation zones. Such formation zones may include subterranean oil and gas shale formations, sandstone formations, and/or carbonate formations.

Often, shaped charges are used to form the perforations within the wellbore. These shaped charges, serve to focus ballistic energy onto a target, thereby producing a round perforation hole (in the case of conical shaped charges) or a slot-shaped/linear perforation (in the case of slot shaped charges) in, for example, a steel casing pipe or tubing, a cement sheath and/or a surrounding geological formation. In order to make these perforations, shaped charges typically include an explosive/energetic material positioned in a cavity of a housing (i.e. a shaped charge case), with or without a liner positioned therein. It should be recognized that the case or housing of the shaped charge is distinguished from the casing of the wellbore, which is placed in the wellbore after the drilling process and may be cemented in place in order to stabilize the borehole prior to perforating the surrounding formations. Often, the explosive materials positioned in the cavity of the shaped charge case are selected so that they have a high detonation velocity and pressure. When the shaped charges are initiated, the explosive material detonates and creates a detonation wave, which will generally cause the liner (when used) to collapse and be ejected/expelled from the shaped charge, thereby producing a forward moving perforating material jet that moves at a high velocity. The perforating jet travels through an open end of the shaped charge case which houses the explosive charge, and serves to pierce the perforating gun body, casing pipe or tubular and surrounding cement layer, and forms a cylindrical/conical tunnel in the surrounding target geological formation.

Typically, liners include various powdered metallic and non-metallic materials and/or powdered metal alloys, and binders, selected to generate a high-energy output or jet velocity upon detonation and create enlarged hole (commonly referred to as "big hole") or deep penetration ("DP") perforations. These liners, however, may leave undesirable slugs/residuals of the liner material in the perforation tunnel, which may reduce and/or block flow of the fluid/gas in the perforation tunnel. Additionally, the perforating jet formed by typical liners may form a crushed zone (i.e., perforation skin, or layer of crushed rock between the round perforation/slot-shaped perforation tunnel and the reservoirs) in the surrounding formation, which reduces the permeability of the surrounding formation and, in turn, limits the eventual flow of oil/gas from the reservoir.

Liners having high quantities of tungsten are known, which may help to increase the depth of the perforation tunnel formed upon detonation of shaped charges, as exemplified in U.S. Pat. No. 5,567,906. A disadvantage of these liners is that in order to create a deep penetrating perforation the shaped charge jet may be extremely narrow in geometry and require a large quantity of high density powdered metallic materials.

Efforts to reduce slug formation, further clear the perforation tunnel, and/or remove the crushed zone have included the use of reactive liners. Such reactive liners are typically made of a plurality of reactive metals that create an exothermic reaction upon detonation of the shaped charge in which they are utilized. Powdered metallic materials often used by the reactive liners include one or more of lead, copper, aluminum, nickel, tungsten, bronze and alloys thereof. Such liners are, for instance, described in U.S. Pat. No. 3,235,005, U.S. Pat. No. 3,675,575, U.S. Pat. No. 8,075,715, U.S. Pat. No. 8,220,394, U.S. Pat. No. 8,544,563 and DE Patent Application Publication No. DE102005059934. Some of these powdered metallic materials may be heterogeneous or non-uniformly distributed in the liner, which may lead to reduced performance and/or non-geometric perforation holes. Another common disadvantage of these liners is that they may not be able to sufficiently reduce slug formation, clear the perforation tunnel, and/or remove the crush zone formed following detonation of the shaped charge.

Some metallic liner materials include powdered metallic materials having grain sizes that are less than 50 micrometers in diameter, while others may include larger grain sizes. Difficulty mixing the metals during the liner formation process may result in imprecise or inhomogeneous individual liner compositions with heterogeneous areas, (e.g., areas where the liner composition is predominantly a single element, rather than a uniform blend), within the liner structure. Efforts to improve mass producability of liners are sometimes met with compromised performance of the liners.

In view of the disadvantages associated with currently available methods and devices for perforating wellbores using shaped charges, there is a need for a device and method that provides a composition including metal powders for use in a shaped charge liner that is capable of generating an energy sufficient to initiate an exothermic reaction upon detonation of the shaped charge. Additionally, there is a need for shaped charge liners capable of forming an exothermic reaction to generate a thermal energy that creates a uniform perforating jet. Further, there is a need for a liner and/or a shaped charge including a liner, having a homogenous composition of metal powders having distinct grain size ranges. Finally, there is a need for a shaped charge liner in which its components allow for a more effective perforating jet, without adding significantly to overall shaped charge costs.

BRIEF DESCRIPTION

According to an aspect, the present embodiments may be associated with a shaped charge liner having a composition including metal powders. The composition includes one or more of an aluminum metal powder and a titanium metal powder, wherein each of the aluminum metal powder and the titanium metal powder includes grains ranging in size from about 50 micrometers to about 150 micrometers. The composition may further include a bronze metal powder having two or more different grain size ranges, the grain size ranges being selected from the ranges comprising about 50 micrometers to about 150 micrometers, about 100 micrometers to about 124 micrometers, about 125 micrometers to about 159 micrometers, about 160 micrometers to about 179 micrometers, and about 180 micrometers to about 250 micrometers. According to an aspect, the composition also includes a tungsten metal powder having grains having sizes up to about 200 micrometers, and a graphite powder having grains having sizes up to about 100 micrometers.

More specifically, the present embodiments relate to a method of forming a shaped charge liner. The method includes providing a composition including metal powders, mixing the composition to form a homogenous metal powder blend, and compressing the homogenous metal powder blend to form a desired liner shape. The composition may include the metal powders substantially as described hereinabove. The composition may include non-metal materials such as graphite. According to aspect, a lubricant, such as a lubricating oil, is intermixed with the composition to assist in the formation of the shaped charge liner.

BRIEF DESCRIPTION OF THE FIGURES

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Various features, aspects, and advantages of the embodiments will become more apparent from the following detailed description, along with the accompanying figures in which like numerals represent similar components throughout the figures and text. The various described features are not necessarily drawn to scale, but are drawn to emphasize specific features relevant to some embodiments.

DETAILED DESCRIPTION

Reference will now be made in detail to various embodiments. Each example is provided by way of explanation, and is not meant as a limitation and does not constitute a definition of all possible embodiments.

For purposes of illustrating features of the embodiments, embodiments will now be introduced and referenced throughout the disclosure. Those skilled in the art will recognize that these examples are illustrative and not limiting and are provided purely for explanatory purposes.

Figure 1A:
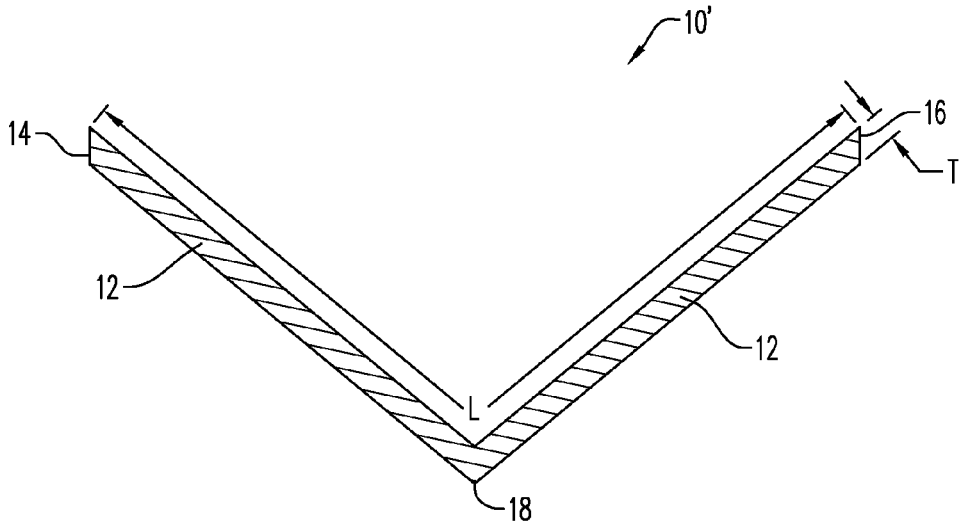
FIG. 1A is a cross-sectional view of a conical shaped charge liner having a composition of metal powders, according to an embodiment.
Figure 1B:
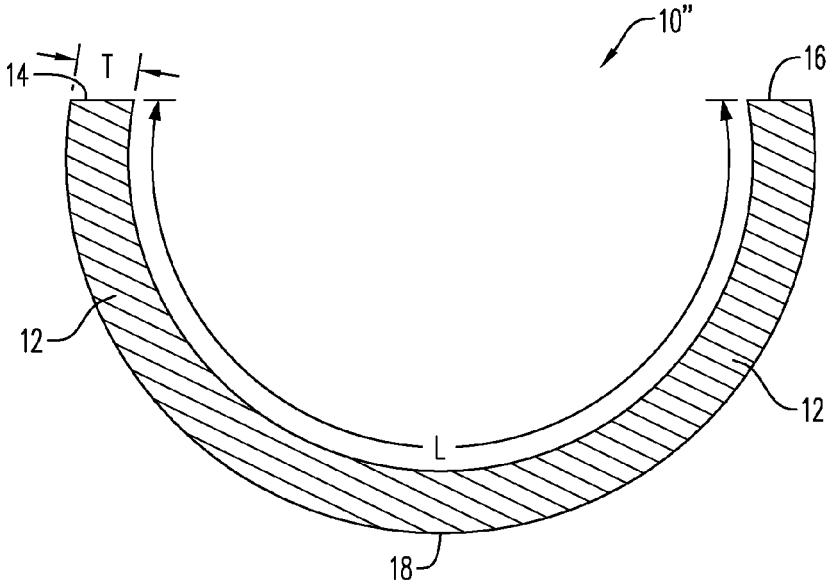
FIG. 1B is a cross-sectional view of a hemispherical shaped charge liner having a composition of metal powders, according to an embodiment.
Figure 1C:
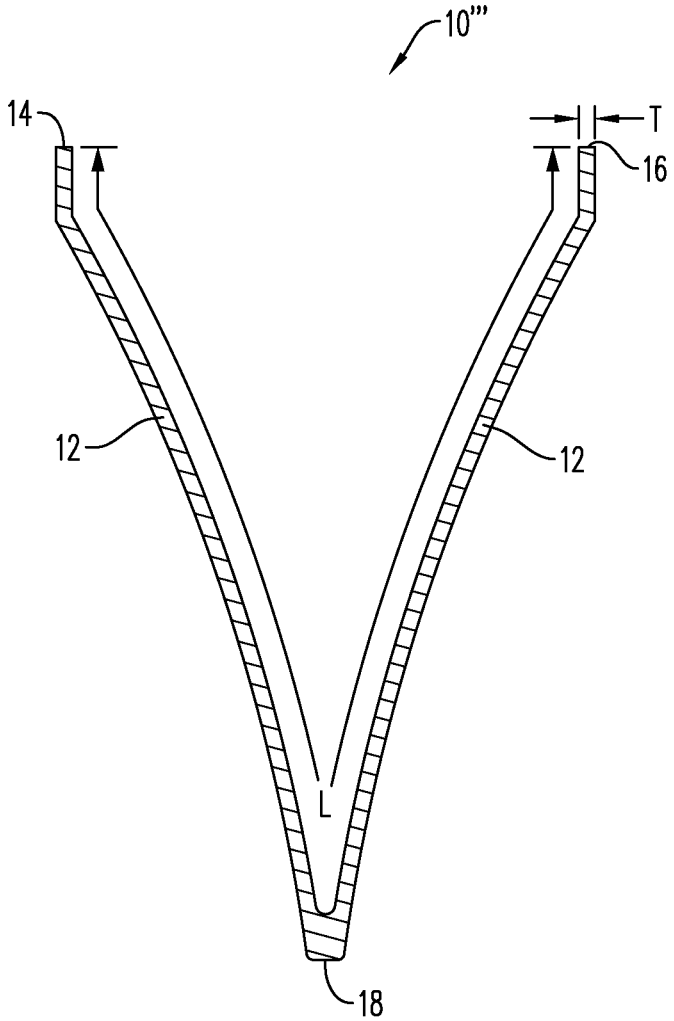
FIG. 1C is a cross-sectional view of a trumpet shaped charge liner having a composition of metal powders, according to an embodiment.
Figure 2:
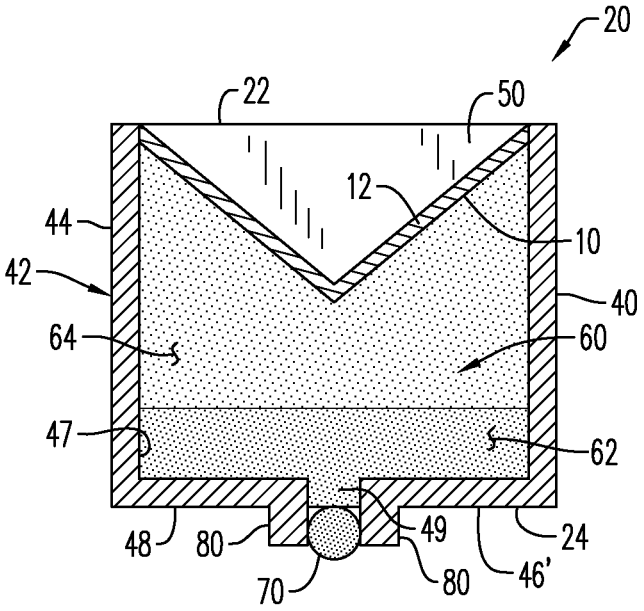
FIG. 2 is a cross-sectional view of a slot shaped charge having a shaped charge liner, according to an embodiment.
Figure 3:
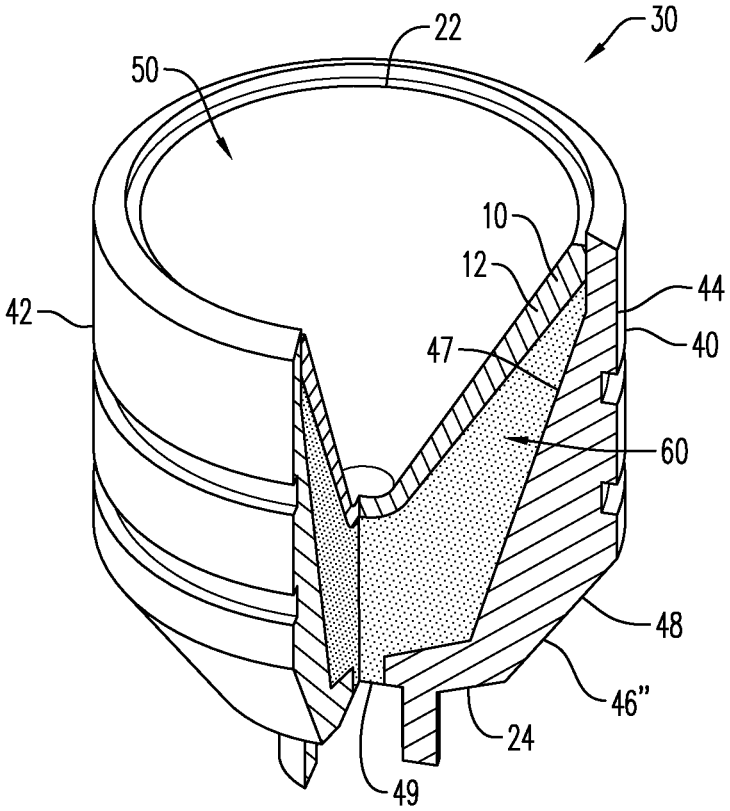
FIG. 3 is a perspective view of a conical shaped charge having a shaped charge liner, according to an embodiment.

In the illustrative examples and as seen in FIGS. 1-3 a liner 10 for use in a shaped charge 20, 30 is illustrated. As illustrated in FIGS. 2-3, the shaped charge 20, 30 may include a case/shell 40 having a plurality of walls 42. The plurality of walls may include a side wall 44 and a back wall 46', 46", that together define a hollow interior/cavity 50 within the case 40. The case 40 includes an inner surface 47 and an outer surface 48. An explosive load 60 may be positioned within the hollow interior 50 of the case 40, along at least a portion of the inner surface 47 of the shaped charge case 40. According to an aspect, the liner 10 is disposed adjacent the explosive load 60, so that the explosive load 60 is disposed adjacent the side walls 44 and the back walls 46', 46" of the case 40. The shaped charges 20, 30 have an open end 22, through which a jet is eventually directed, and a back end (closed end) 24, which is typically in communication with a detonating cord 70.

The illustrative liners 10A/10B/10C, as seen for instance in FIGS. 1A-1C, may be formed of a single layer (as shown). In an alternative embodiment, the liner 10A/10B/10C may also include multiple layers (not shown). An example of a multiple-layered liner is disclosed in U.S. Pat. No. 8,156,871, hereby incorporated by reference to the extent that it is consistent with the disclosure. In an embodiment, the shaped charge liner 10A/10B/10C has a thickness T ranging from between about 0.5 mm to about 5.0 mm, as measured along its length L. The thickness T is, in one embodiment uniform along the liner length L, but in an alternative embodiment, the thickness T varies in thickness along the liner length L, such as by being thicker closer to the walls of the case 40 and thinner closer to the center of the shaped charge 20, 30 (or apex 18 of the liner). Further, in one embodiment, the liner 10A may extend across the full diameter of the cavity 50 as shown. In an alternative embodiment, the liner 10A/10B/10C may extend only partially across the diameter of the cavity 50, such that it does not completely cover the explosive load 60 (not shown). The liner 10A/10B/10C may be present in a variety of shapes, including conical shaped as shown in FIG. 1A, hemispherical or bowl-shaped as shown in FIG. 1B, or trumpet shaped as shown in FIG. 1C. The conical, hemispherical and trumpet liners 10A, 10B, 10C, respectively, may collectively be referred to as a liner/(s) 10. The composition 12 of the liner 10 may be substantially uniform when measured at any position along the length of the liner 10. For instance, a measurement of the constituents of the liner 10 taken at a first end 14 of the liner 10 may be identical to another measurement of the constituents of the liner 10 taken at a second end 16 or an apex (i.e., a midpoint between the first and second ends 14, 16) 18 of the liner 10.

The shaped charge liner 10 includes a composition 12 having a plurality of powders. The powders may be formed by any powder production techniques, such as, for example, grinding, crushing, atomization, and various chemical reactions. Each powder in the composition 12 may be one of a powdered pure metal, and a metal alloy. According to an aspect, each powder and/or type of powders of the composition 12 is present in an amount that is less than 80% w/w of the composition 12. Alternatively, each powder and/or type of powders of the composition 12 may be present in an amount that is either less than 70%, 50%, or 40% w/w of the composition 12. The plurality of powders includes one or more metal powders. According to an aspect, the composition 12 includes one or more of an aluminum metal powder and a titanium metal powder. The liner 10 may further include a bronze metal powder, a tungsten metal powder and a graphite powder. Each type of powder includes a grain size range or distribution that may be the same or different from the grain size ranges of another powder. For example, a metal powder may include grain size ranges from between about 50 micrometers to about 150 micrometers, while another metal powder includes grain size ranges from about above 150 micrometers to about 300 micrometers. The differences in the grain size ranges of the powders in the composition 12 may help facilitate a uniform/homogenous mixture of the powders, (and in particular, of the metal powders) throughout the liner structure, which may aid in improving the high velocity/energy jet formed by the liner 10 upon detonation of the shaped charge 20, 30. As used herein, the term "homogenous powder blend" refers to an even/uniform particle size distribution of all the powders of the composition, as measured along the length of the liner and along the cross-wise portion (or width) of the liner. A liner having a homogenous powder blend may include a powder distribution variance, i.e., a standard deviation in the grain size distribution, of 1 to 5%. A liner having a homogenous powder blend includes an even distribution of grain size ranges and types of powders throughout both the width and the length of the liner. The use of different grain size ranges in the composition 12 may help to increase consolidation of the metal powders, increase uniformity/homogeneity of the resultant composition 12 following mixture and compression, and ultimately enhance jet formation of the shaped charge liner 10. Such homogeneity within the liner composition may also produce a more uniform hydrodynamic jet upon detonation of the shaped charge 20/30. The distribution of the grain sizes in the liner 10 may also help facilitate a consistent collapse process of the liner 10, thereby helping to enhance performance of the shaped charges 20, 30 within which they are used. In an embodiment, the thermal energy formed upon detonation of the shaped charges 20,30 may melt some of the powders of the composition 12, and/or at least reduce internal stress in the individual grains of the powders, which may also improve jet formation and enhance its uniformity. Additionally, the different grain size ranges or distribution utilized can also improve the density or porosity of the liner 10. According to an aspect, the shaped charge liners 10 including the composition 12 may have a density ranging from between about 8 g/cm$^3$ to about 14 g/cm$^3$, alternatively, between about 10 g/cm$^3$ and about 12 g/cm$^3$.

The shaped charge liner may further include a binder and/or a lubricant that aids with enhancing the producibility and the homogeneity of the composition 12 of the liner 10. According to an aspect, the binder and lubricant may serve as a carrier agent that helps facilitate the homogeneity of the composition 12. The binder may include a polymer resin or powder, or wax or graphite. According to an aspect, the binder can also be an oil-based material. Other binders may include soft metals such as lead or copper. The lubricant may enhance processability of the powders in the composition 12. The lubricant may help to bind one or more of the powders in the composition 12 having low grain size ranges, such as, for example graphite powder, so that during the mixing process, the risk of loss of powders due to their fineness or low granularity and/or potential contamination of the work environment is reduced. According to an aspect, the graphite powder may function as the lubricant. In an embodiment, the shaped charge liner 10 additionally includes an oil, which may function as the lubricant, and prevent oxidation of the liner 10. The oil may be uniformly intermixed with each of the metal powders and the graphite powder. The oil may also enhance the homogeneity of the powders along the length L (and across the thickness T) of the liner 10. The oil, even when present in trace amounts, aids with thorough blending/mixing of the powders (having various grain size ranges) of the composition 12. It is envisioned that each of the powders, the binder and the lubricant will be uniformly interspersed throughout the liner 10, so that the liner 10 will have the same properties along any portion of its length L.

As used herein "grain size distribution" or "grain size range/(s)" refers to the range of diameters of each grain of a powder, such as a metallic/metal powder having generally spherical shaped grains, and also refers to irregular (non-spherical) shaped grains. One or more of the metal powders may include grains of two or more different grain size ranges. While it is possible to have individual grains present within a sample that vary in size, the predominant number of grain sizes (or the particle size distribution) within the sample will be in the stated range/(s). As would be understood by one of ordinary skill in the art, manufacturers of metallic powders traditionally sell powders in stated ranges or grain size distributions, and it is understood that variability within a stated grain size range may vary by about +/−1 to 5%, and in an embodiment, +/−1-3%.

It is contemplated that the aluminum metal powder and the titanium metal powder may each have a grain size range from about 50 micrometers to about 150 micrometers within the composition 12. In an embodiment, a bronze metal powder includes two or more different grain size ranges selected from about 50 micrometers to about 150 micrometers, about 100 micrometers to about 124 micrometers, about 125 micrometers to about 159 micrometers, about 160 micrometers to about 179 micrometers, and about 180 micrometers to about 250 micrometers. For the purposes of this disclosure, the bronze metal powders are understood to be a copper-tin alloy, encompassing the elements of copper and tin. The embodiments of the present disclosure contemplates an exemplary bronze metal powder that consists essentially of 90% copper and 10% tin. The bronze metal powder (copper-tin alloy) may be present in the composition in an amount up to about 35% w/w of the composition 12, alternatively up to about 30% w/w of the composition 12.

In an embodiment, the tungsten metal powder includes a grain size range of up to about 200 micrometers. The tungsten metal powder may include two or more different grain size ranges from between about 1 micrometer to about 49 micrometers, about 50 micrometers to about 99 micrometers, about 100 micrometers to about 149 micrometers, and about 150 micrometers to about 200 micrometers. Tungsten may be present in the composition in an amount less than 90% w/w of the composition 12, in an amount less than 70% w/w of the composition 12, in an amount less than 50% w/w of the composition 12, or in an amount less than 40% w/w of the composition 12.

According to an aspect, the graphite powder includes grain sizes of up to about 100 micrometers. The graphite powder may include two or more different grain size ranges from between about 1 micrometer to about 24 micrometers, about 25 micrometers to about 49 micrometers, about 50 micrometers to about 74 micrometers, and about 75 micrometers to about 100 micrometers. According to an aspect, the graphite powder is present in the composition in an amount between 0.5% to about 5.0% w/w of the composition 12.

The composition 12 of the liner 10 undergoes an exothermic reaction, which may occur even at lower energies, such as in shaped charges 20, 30 including when a small or decreased amount of explosive materials, or lower energy explosive materials, is used in the explosive load 60. As illustrated in FIG. 2, and according to an aspect, the explosive load 60 utilized in the shaped charges 20, 30 may include a primary explosive load 62 and a secondary explosive load 64. The primary explosive load 62 may be positioned between the secondary explosive load 64 and the back wall 46' of the shaped charge 20, adjacent an initiation point 49 arranged at the back wall 46'. While FIGS. 2 and 3 each illustrate a single initiation point 49, it is envisioned that two of more initiation points 49 may be provided in the shaped charge 20, 30. Alternatively, as illustrated in FIG. 3, the explosive load 60 may only encompass one layer. A detonating cord 70 (optionally aligned by guiding members 80), may be adjacent the initiation point. While not illustrated in the conical shaped charge 30 of FIG. 3, it is contemplated that such conical shaped charges may also include primary and secondary explosive loads 62, 64, as the application may require. To be sure, the liner 10 described herein may be utilized in any shaped charge.

Additionally, while there are numerous grain sizes that can be used, it has been found that the aforementioned grain sizes and ranges in the composition 12 help provide a more homogenous mixture of the powders in the composition 12, thus enhancing the shaped charge liner's 10 ability to create a reproducible high-energy output or jet velocity upon detonation of the shaped charge 20, 30. Each of the selected metal powders (and nonmetal powders as appropriate) may be present within the liner 10 in different grain size ranges. According to an aspect, one of the metal powders may include two or more grain size ranges, and one of those grain size ranges may be the same as the grain size ranges of another metal powder. Additionally, each metal powder may be included in different proportions of a total weight of the composition 12. According to an aspect, the shaped charge liner 10 includes three metal powders and a graphite powder. According to one aspect, the shaped charge liner 10 includes multiple metal powders and a nonmetal powder.

According to an aspect, the composition 12 of the shaped charge liner 10 may help the liner 10 produce an energy through a chemical and/or intermetallic reaction between two or more of the components. Such reactions may also occur between one or more of the constituents of the composition 12, and portions of the surrounding formation (such as, the well bore fluid and/or formation fluids). The composition 12 may include one or more of an aluminum metal powder and a titanium metal powder, a bronze metal powder, a tungsten metal powder, and a graphite metal powder. One or more of the powders may exothermically react with another of the powders. The reaction may occur at a relatively low temperature, and may help to produce additional energy, that is, energy that is not formed by the activation of explosive loads 60 of a shaped charge 20, 30 as described in more detail hereinbelow. The additional energy produced by the composition 12 may raise the total energy of the shaped charge liner 10 to a temperature level that helps facilitate a second reaction within the perforation tunnel. This second reaction may be an exothermic reaction and an intermetallic reaction that produces less, the same, or more energy than the initial explosion that forms the perforating jet. In other words, the second reaction may require a higher ignition temperature, but the end result may be a more consistent collapse of the liner 10, which leads to more reliability of the performance of the shaped charges 20, 30. For instance, for compositions 12 including titanium and aluminum (i.e., Ti—Al), or alternatively titanium and carbon (i.e. Ti—C), the reactions that occur are represented by the following chemical formulas:

$$Ti+2Al=TiAl_2 \quad \text{(Formula 1)}$$

$$Ti+C=TiC \quad \text{(Formula 2)}$$

where, Ti represent titanium, Al represents Aluminum, and C represents Carbon. In the reaction according to Formula 1, the ignition temperature is 400° C. and the heat generated by the reaction is 520 cal/g. In the reaction according to Formula 2, however, the ignition temperature is about 600° C. and the heat generated is about 860 cal/g.

According to an aspect, compositions 12 having both the copper metal powder and the aluminum metal powder may include a copper-aluminum reaction, such as the reaction represented by the following chemical formula:

$$Cu+Al=CuAl_2 \quad \text{(Formula 3)}$$

where, Cu represents copper and Al represents aluminum. In the reaction according to Formula 3, the ignition temperature is 545° C. and the heat generated by the reaction is 108 cal/g.

Typical reactions may be formed according to the data presented in a technical report titled "Incendiary Potential of Exothermic Intermetallic Reactions" prepared by Lockheed Palo Alto Research Laboratory, designated as Technical Report AFATL-TR-71-87, and dated July 1971. Without intending to be bound by the theory, it is also contemplated that additional reactions may occur between three or more of the powders of the composition 12, such as, for example, between copper, aluminum and titanium, and between copper, titanium and carbon.

According to an aspect, when the composition 12 includes the aluminum metal powder rather than the titanium metal powder only, or both the aluminum and the titanium metal powders, the aluminum metal powder includes grain size ranges from about 50 micrometers to about 150 micrometers. In an embodiment, the grain size ranges of the aluminum metal powder is from about 50 micrometers to about 125 micrometers. The aluminum metal powder may be present in an amount less than about 10% w/w of the total weight of the composition 12. According to an aspect, the aluminum metal powder may be present in an amount of between about 5% and about 10% w/w of the total weight of the composition 12. In an embodiment, when the aluminum metal powder includes grain size ranges of between 50 micrometers and 125 micrometers, it is present in an amount less than about 5% w/w of the composition 12.

According to an aspect, when the composition 12 includes the titanium metal powder rather than the aluminum metal powder only, or both the aluminum and the titanium metal powders, the titanium metal powder includes grain size ranges of from about 50 micrometers to about 150 micrometers. The titanium metal powder may be present in an amount less than about 10% w/w of the composition 12. In an embodiment, the titanium metal powder is present in an amount of about 5% to an amount of about 10% w/w of the composition 12. According to an aspect, the titanium metal powder is present in an amount of about 8% w/w of the composition 12.

According to an aspect, the composition 12 includes both the aluminum metal powder and the titanium metal powder. The aluminum metal powder may be present in an amount of less than about 5% w/w of the composition 12, while the titanium metal powder is present in an amount of about 5% to about 10% w/w of the composition 12. In an embodiment, the aluminum metal powder is present in an amount of about 3% w/w of the composition 12 and the titanium metal powder is present in an amount of about 6% w/w of the composition 12. The aluminum may include grain size ranges of up to about 150 micrometers. According to an aspect, the aluminum metal powder includes grain size ranges of between about 50 micrometers and about 125 micrometers. In an embodiment, the aluminum metal powder grain size ranges between about 50 micrometers and about 75 micrometers. The aluminum metal powder may include grains having a size of about 63 micrometers.

In an embodiment, the composition 12 includes the bronze metal powder having two or more different grain size ranges. According to an aspect, the bronze metal powder includes three or more different grain size ranges. In an embodiment, the bronze metal powder includes four or more different grain size ranges. The grain sizes may include grain size ranges of from about 50 micrometers to about 99 micrometers, about 100 micrometers to about 124 micrometers, about 125 micrometers to about 159 micrometers, about 160 micrometers to about 179 micrometers, and about 180 micrometers to about 250 micrometers. The grain size ranges of the bronze metal powder may be selected based on the needs of the particular application, and in some embodiments, according to the other metal powders of the composition 12. According to an aspect, the bronze metal powder includes two or more different grain size ranges. It has been found that the grain size distributions described herein may help to facilitate mixing homogeneity of the bronze metal powder, and the overall composition 12.

According to an aspect, the bronze metal powder is present in an amount less than about 30% w/w of the composition 12. In embodiments including the bronze metal powder and the aluminum metal powder, the bronze metal powder is present in the amount less than about 30% w/w of the composition 12, while the aluminum metal powder is present in an amount up to about 8% the composition 12. The bronze metal powder may be less than about 27% w/w of the composition 12. In a further embodiment, at least about 5% w/w of the composition 12 is the bronze metal powder having grain size ranges of between about 100 micrometers to about 125 micrometers. According to an aspect, at least about 2% to about 15% w/w of the composition 12 is the bronze metal powder including grain size ranges of between about 180 micrometers to about 250 micrometers, at least about 2% to about 10% w/w of the composition 12 is the bronze metal powder including grain size ranges between about 160 micrometers to about 179 micrometers, and at least about 2% to about 10% w/w of the composition 12 is the bronze metal powder including grain size ranges between about 125 micrometers to about 159 micrometers. The bronze metal powder may, in still a further embodiment, be included in an amount of about 9% w/w and having grain size ranges between about 180 micrometers to about 250 micrometers, at least about 5% w/w, with grain size ranges between about 160 micrometers to about 179 micrometers, and alternatively, in an amount of at least about 5% w/w and of having a grain size ranging between about 125 micrometers to about 159 micrometers.

The composition 12 of the shaped charge liner 10 may include up to about 5% w/w of aluminum metal powder. The aluminum metal powder may be present in an amount of about 3% w/w of the composition 12. The aluminum metal powder may react with the copper component of the bronze metal powder (copper-tin alloy), thereby helping to facilitate more effective jet formation through the hydrodynamic process by the shaped charge liner 10. In an embodiment, the copper component of the bronze metal powder is present in amount up to about 25% w/w of the composition 12.

According to an aspect, the tungsten metal powder may include grain size ranges of up to about 200 micrometers. As described in further detail hereinabove, the tungsten metal powder may include two or more different grain size ranges, ranging from between about 50 micrometers to about 99 micrometers, about 100 micrometers to about 149 micrometers, and 150 micrometers to about 200 micrometers. In an embodiment, the tungsten metal powder is present in an amount between about 40% to about 90% w/w of the composition 12. According to an aspect, the tungsten metal powder is present in an amount less than 40% w/w of the composition 12. When the composition 12 includes the tungsten metal powder and the aluminum metal powder, the aluminum metal powder may be present in an amount of about 5% to about 10% w/w of the composition 12. According to an aspect, the aluminum metal powder is present in an amount up to about 8% w/w of the composition 12.

According to an aspect, the graphite powder may include a grain size up to about 100 micrometers. As described in further detail hereinabove, the graphite powder may include two or more different grain sizes ranging from between about 25 micrometers to about 49 micrometers, alternatively grain size ranges of 50 micrometers to about 74 micrometers, and alternatively 75 micrometers to about 100 micrometers. The graphite powder may be present in an amount of less than about 5% w/w of the composition 12. According to an aspect, the graphite powder is present in an amount of less than about 2% w/w of the composition 12. In embodiments including the graphite powder and the titanium metal powder, the titanium metal powder may be present in an amount of about 5% to about 10% w/w of the composition 12, or in an amount up to about 8% w/w of the composition 12. The graphite powder included in the composition 12 may demonstrate a carbon content of between about 90 wt % and about and 92 wt % of the graphite powder.

According to an aspect, the composition 12 of the shaped charge liner 10 may include a lead metal powder. As described hereinabove, such lead metal powder may also act as a binder. The lead metal powder may include one or more of a first grain size and a second grain size. In an embodiment, the first grain size ranges from between 150 micrometers to about 300 micrometers. The second grain size may be up to about 120 micrometers. In an embodiment, the lead metal powder comprises the first grain size and the second grain size, thus helping to form the homogenous metal powder blend. By mixing lead metal powders having different grain sizes, it has been found that homogenous mixing was more easily achieved. According to an aspect, the lead metal powder is present in an amount between about 10% w/w and about 30% w/w of the composition 12. Alternatively, the lead metal powder may be present in an amount of about 12% w/w to about 24% w/w of the composition 12.

Embodiments of the liners of the present disclosure may be used in a variety of shaped charges 20, 30, which incorporate the described shaped charge liners 10. As noted, the shaped charge of FIG. 2 is a slot shaped charge 20, having an open end 22, and a closed end 24 formed in its flat back wall 46'. In contrast, the shaped charge of FIG. 3 is a conical shaped charge having an open end 22, and a conical shaped back wall 46". The shaped charges are detonated via a detonation cord 70 that is adjacent an area of the back walls 46', 46" and is in communication with an explosive load positioned within a cavity (hollow interior) of the shaped charge.

FIGS. 2-3, illustrate the shaped charges 20, 30 including a case 40 defining a cavity 50. According to an aspect, the shaped charges 20, 30 include an explosive load 60 disposed within the cavity 50 of the case 40. A shaped charge liner 10 may be disposed adjacent the explosive load 60, thus retaining the explosive load 60 within the cavity 50 of the case 40. The liner 10A, while shown in a conical configuration in the shaped charges of FIGS. 2-3, may also be present in a hemispherical configuration 10B as shown in FIG. 1B. The liner 10 may include a composition 12 that includes metal powders. Therefore, the shaped charge liners 10 of the present disclosure may serve multiple purposes, such as, to maintain the explosive load 60 in place until detonation, and to accentuate the explosive effect on the surrounding geological formation.

For purposes of convenience, and not limitation, the general characteristics of the shaped charge liner 10 are described above with respect to the FIG. 1, and are not repeated here.

According to an aspect, the liner 10 of the shaped charges 20, 30 includes the composition 12 substantially as described hereinabove. For instance, the composition 12 may include one or more of an aluminum metal powder and a titanium metal powder. The aluminum metal powder and/or the titanium metal powder may include a grain size that ranges from about 50 micrometers to about 150 micrometers. In an embodiment, the titanium metal powder and/or the aluminum metal powder is present in an amount less than about 10% w/w of the composition 12.

The composition 12 may further include a bronze metal powder. In an embodiment, the bronze metal powder is present in an amount less than about 30% w/w of the composition 12 of the liner 10. According to an aspect, the bronze metal powder includes two or more different grain size ranges. The grain sizes of the bronze metal powder may range from about 50 micrometers to about 150 micrometers, about 100 micrometers to about 124 micrometers, about 125 micrometers to about 159 micrometers, about 160 micrometers to about 179 micrometers, and about 180 micrometers to about 250 micrometers. According to an aspect, the bronze metal powder includes up to four different grain sizes. In an embodiment, at least about 5% to about 15% w/w of the composition 12 is the bronze metal powder having a grain size ranging between about 180 micrometers to about 250 micrometers, at least about 2% to about 10% w/w of the composition 12 is the bronze metal powder having a grain size ranging between about 160 micrometers to about 179 micrometers, and at least about 2% to about 10% w/w of the composition 12 is the bronze metal powder having a grain size ranging between about 125 micrometers to about 159 micrometers. According to an aspect, the composition 12 of the liner 10 of the shaped charges 20, 30 includes a tungsten metal powder having a grain size up to about 200 micrometers, and a graphite powder having a grain size of up to about 100 micrometers.

The liners 10 of the shaped charges 20, 30 may be formed to a desired shaped prior to being placed/installed within the shaped charges 20, 30. In an embodiment, the liners 10 are pre-pressed to their desired shape, and are thereafter installed in the shaped charge 20, 30 by being machine or manually placed onto the explosive load 60.

Figure 4:
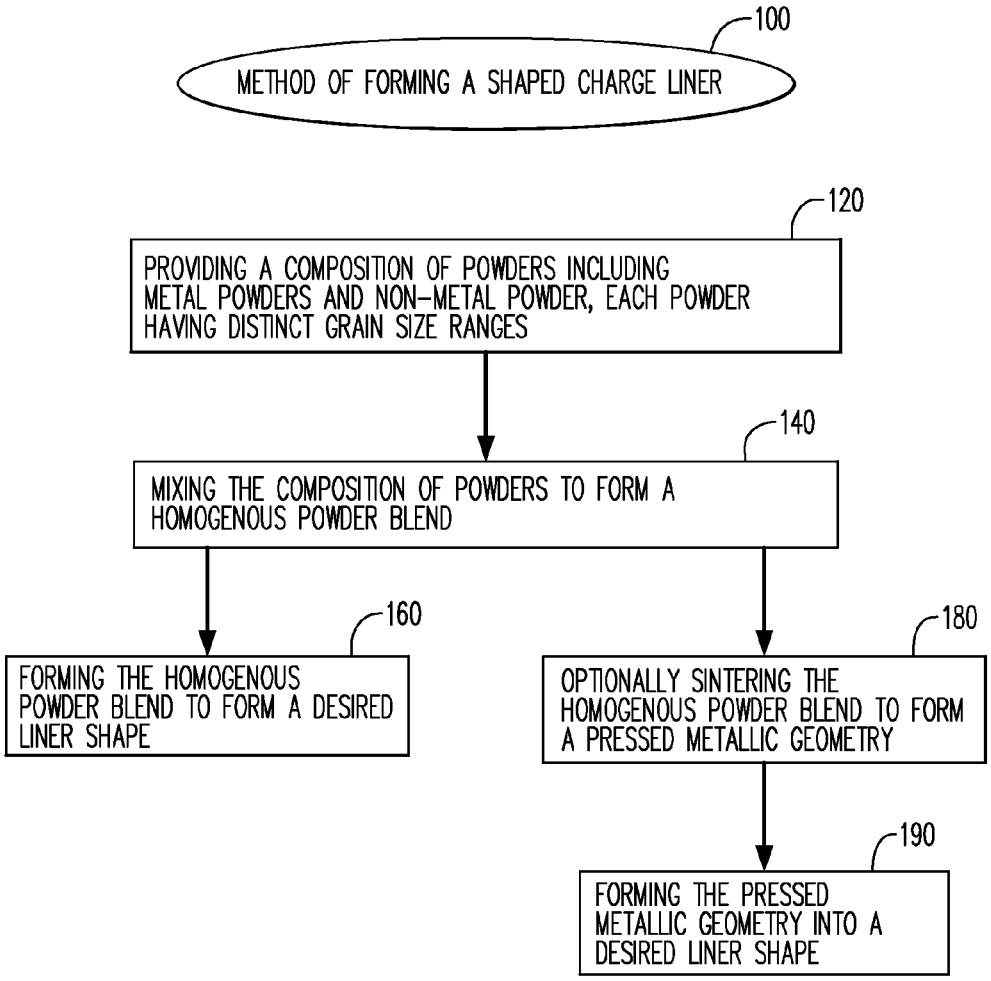
FIG. 4 is a flow chart illustrating a method of forming a shaped charge liner, according to an embodiment.
Figure 5:
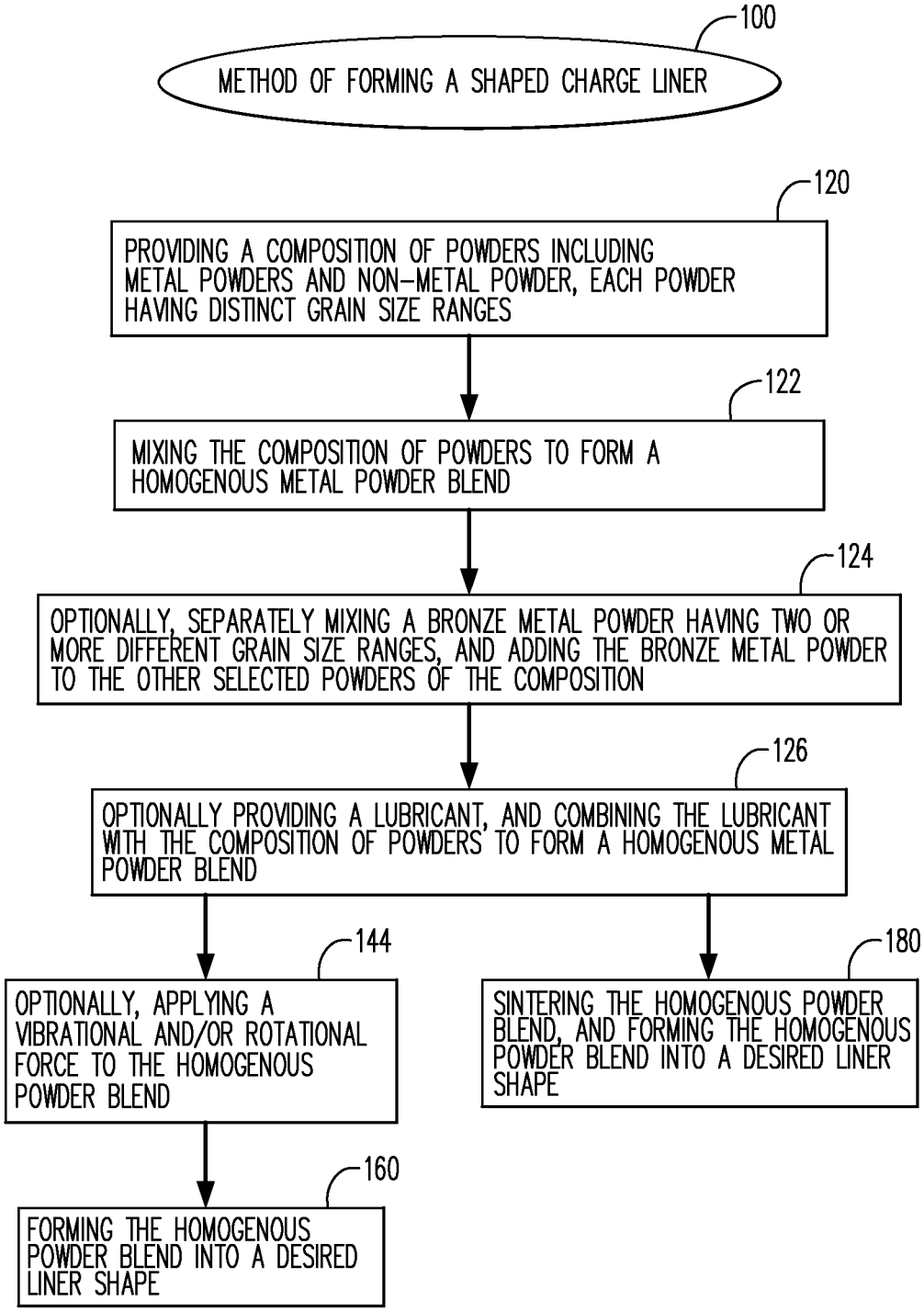
FIG. 5 is a flow chart illustrating a further method of forming a shaped charge liner, according to an embodiment.

Turning now to FIG. 4, a flow chart is provided that illustrates a method 100 of forming a shaped charge liner 10. According to an aspect, the method 100 includes the steps of providing 120 a composition that includes a variety of metal powders each having distinct grain size ranges, mixing 140 the composition of metal powders to form a homogenous metal powder blend by utilizing the different powder grain size ranges/distributions to enhance homogeneity, and forming 160 the homogenous metal powder blend to form a desired liner shape. The forming 160 may include compressing the homogenous powder blend under a specified force, such as a force of about of up to about 1,000 kilonewtons (kN) to form the desired liner shape. During the forming 160 step, the homogenous powder blend may also be subjected to one or more of a vibrational and a rotational force. The composition may include the various embodiments of the composition as substantially described hereinabove. The method may, optionally, include sintering 180 the homogenous powdered blend to form a pressed metallic shaped geometry and forming 190 the pressed metallic shaped geometry into the desired liner shape. The shaped charge liner 10 described herein may, optionally, be formed by a molding process, whereby the composition of metal powders are combined with a binder and placed into an injection mold having a negative imprint of the desired shape of the liner. According to an aspect, in an alternative embodiment of the method, as shown in the steps of FIG. 5, the mixing includes separately mixing 142 the bronze metal powder having the two or more different grain size ranges, prior to mixing the composition. The mixing step may be optionally accomplished by a mixer that mixes the powders at a mix speed of about 2 revolution/second (revs/sec) to about 4,000 revs/sec, alternatively between about 1,000 rev/sec and 3,000 revs/sec, and alternatively between about 2 revs/sec to about 2,000 revs/sec. This step of mixing may be performed for about 500 seconds, alternatively between about 30 seconds to about 200 seconds. Optionally, bronze metal powders having two or more grain sizes are mixed separately. Optionally, the homogenous powder blend is subjected to vibrational and/or rotational forces 144, and the liner is compressed to form the desired liner shape. In lieu of only applying a compression force with the optional vibration and rotation forces, the homogenous metal powder blend may be compressed 180 to form a pressed metallic geometry having the desired liner shape, and sintered to increase adhesion between the powders and enhance the overall performance of the liner 10.

Figure 6:
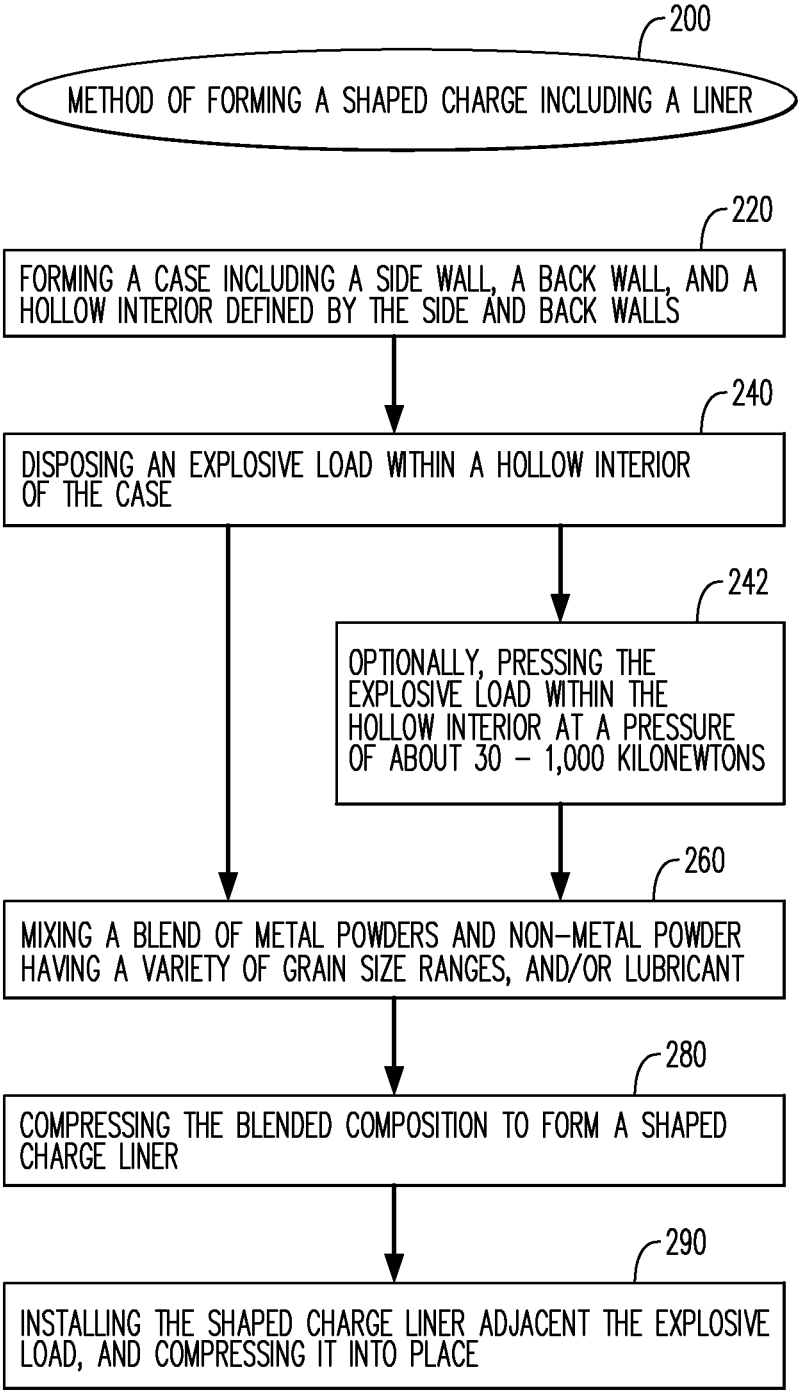
FIG. 6 is a flow chart illustrating a method of forming a shaped charge including a shaped charge liner, according to an embodiment.

In an embodiment of a method 200, a shaped charge 20, 30 is formed having a liner/shaped charge liner 10 utilizing the steps described in FIG. 6. The method 200 of forming the shaped charge may include forming a case 220 having a side wall, a back wall, a hollow interior defined by the side wall and the back wall, and an initiation point positioned adjacent to (or within) the back wall. The method further includes disposing an explosive load 240 within the hollow interior of the case, so that the explosive load is adjacent the back wall, the initiation point, and at least a portion of the side wall. According to an aspect, the explosive load includes one or more explosive powders that are arranged within the hollow interior. The explosive powders may be loosely place in the hollow interior. In an embodiment, the explosive load is compressed 242 within the hollow interior of the case at a force of between about 20 kN to about 1,000 kN. In an alternative embodiment, the explosive load is compressed at a force of between about 30 kN to about 600 kN. According to an aspect, the method further includes mixing 260 a blend of metal powders having a variety of grain size ranges, and optionally non-metal powders and a lubricant. The method further includes compressing 280 the blended composition to form a shaped charge liner. The composition contemplated is substantially as described hereinabove with respect to the shaped charge liners 10 illustrated in FIGS. 1A-1C, and 2-3. According to an aspect, the shaped charge liner is homogeneous along its length, i.e., no individual portion of the liner includes more or less of any individual constituent (powders or lubricant) of the composition. The method may further include installing the shaped charge liner 290 adjacent the explosive load and compressing it into the explosive load, such that the explosive load is positioned between the back and side walls, and the shaped charge liner.

The present invention may be understood further in view of the following examples, which are not intended to be limiting in any manner. All of the information provided represents approximate values, unless specified otherwise.

Example 1

Various compositions 12 for use in shaped charge liners may be made according to the embodiments of the disclosure. The percentages presented in the Example shown in Table 1 are based on the total % w/w of the powders in the composition 12 and exclude reference to deminimis amounts of processing oils or lubricants that may be utilized. Such oils or lubricants may be present in a final mix in an amount of between about 0.01% and 1% of the total % w/w of the powders in the composition 12. The composition 12 may include the following powder components, each component having a selected grain size range.

TABLE 1

| | Grain Size Range(s) | | |
|---|---|---|---|
| Shaped Charge Liner - Sample Composition | Minimum Grain Size (micrometers (μm)) | Maximum Grain Size (micrometers (μm)) | Liner Blend (%) w/w |
| Bronze 1 | 180 | 250 | 0-15.5 |
| Bronze 2 | 160 | 179 | 2-10 |
| Bronze 3 | 125 | 159 | 2-10 |
| Bronze 4 | 75 | 124 | 0-10 |
| Lead 1 | >0 | 120 | 10-15 |
| Lead 2 | 150 | 300 | 10-30 |
| Tungsten | >0 | 200 | 39-74.5 |
| Aluminum | 63 | 125 | 0-10 |
| Titanium | 50 | 150 | 1-10 |
| Graphite | >0 | 100 | 0.5-5 |

The composition 12 presented in Table 1—Sample Composition—may include a bronze metal powder, a lead metal powder, a tungsten metal powder, an aluminum metal powder and/or a titanium metal powder, and a graphite powder. In at least an embodiment, the Sample Composition may include two or more grain size ranges/distributions of the bronze metal powder. The bronze metal powder may have grains ranging in size from between 180 μm to 250 μm, 160 μm to 179 μm, 125 μm to 159 μm, and 75 μm to 124 μm. The lead metal powder may include two different grain size ranges, such as, from between an amount larger than 0 μm to 120 μm, and from 150 μm to 300 μm. The Sample Composition may include either aluminum metal powders or titanium metal powders. In at least one embodiment, both the aluminum and the titanium metal powders are included, the aluminum metal powder ranging from between an amount larger than 0% to 10% w/w of the composition 12, and the titanium metal powder ranging from between an amount larger than 0% to 10% w/w of the composition 12. The tungsten metal powder may be provided in an amount ranging from between about 39% to about 70% w/w of the composition 12. Graphite powder may be included in grain size ranges from between an amount larger than 0 μm to 100 μm. Notably, nickel metal powder was not included in Composition A, which may help reduce potential toxicity levels of the shaped charge liner 10 content.

Various powders may be utilized in the composition 12. For example, powders having a spherical shape/configuration, and powders having an irregular shape may be utilized. For the particular powders in the composition 12 having two or more grain size ranges, in an embodiment, at least one grain size range may include spherically shaped powders, while one or more of the other grain sizes range/(s) include/(s) irregular shaped powders. For instance, bronze metal powders with grain size ranges between 75 μm to about 124 μm may include irregular shaped powders, while bronze metal powders of grain size ranges between at least one of 180 μm to 250 μm, 160 μm to 179 μm, and 125 μm to 159 μm may include spherically shaped powders. The powders of the composition 12 may be obtained from various suppliers. For example, graphite powders sold under the trade name GP 90/92, and available from Graphit Kropfmühl GmbH, Langheinrichstr. 1, 94051 Hauzenberg, Germany may be utilized. Titanium metal powders available from Tropag GmbH, Bundesstr. 4, 20146 Hamburg, Germany may also be utilized.

Without being bound by theory, it is believed that there is synergy between grain size ranges, and the % w/w ranges for the powders of the composition 12. The grain size range data presented in Table 1 was generated through extensive testing, and analysis of material specifications and data sheets, as may be measured by the measuring principle of dynamic image analysis ISO 13322-2 titled "Particle size analysis—Image analysis methods" and prepared by the Technical Committee ISO/TC 24. Although various grain size ranges are provided for each powder, it is envisioned in an alternative embodiment that two or more of the powders may include identical grain size ranges.

Examples 2-3

Sample shaped charges were generally configured to demonstrate the performance of shaped charges incorporating liners made according to embodiments described herein. Each shaped charge included a case/casing, and an initiation point formed in the back wall of the case. An explosive load was arranged within the hollow interior, and liners of different compositions and grain size ranges of powders were positioned adjacent the explosive load. A detonating cord was positioned adjacent the initiation point. The shaped charges were detonated, measurements of the entrance hole diameters and lengths of the perforation jets were taken, and productivity ratio evaluations were made. The values presented in Tables 2 and 3 represent the results of the measurements taken and evaluations made upon detonation of the shaped charges.

Three sets of commercially available (or established liners) were utilized in samples A-1/A-2, B-1/B-2, and C-1/C-2, the liners each including various powders. Samples D-1/D-2, E-1/E-2 and F-1/F-2, however, each included liners having at least one powder with two or more grain size ranges, and at least one powder included a grain size range that was different from the grain size range of another powder. In samples D-1 and D-2, the liners included bronze having five different grain size ranges, lead having two different grain size ranges, and tungsten having one grain size range. In samples E-1 and E-2 the liners included bronze having three different grain size ranges, lead having two different grain size ranges, and tungsten and aluminum each having one grain size range. In samples F-1/F-2, the liners included lead, tungsten, aluminum, and nickel powders.

TABLE 2

| Samples | Average Entrance Hole Diameter (millimeters (mm) | Average Stressed Rock Target Penetration (millimeters (mm)) | Productivity Ratio | Relative Productivity Ratio (%) |
|---|---|---|---|---|
| A-1 | 9.3 | 261 | 1.26 | 100 |
| B-1 | 8.1 | 304 | 1.40 | 111 |
| C-1 | 9.4 | 222 | 1.26 | 100 |
| D-1 | 11.0 | 223 | 1.36 | 108 |
| E-1 | 9.8 | 270 | 1.42 | 113 |
| F-1 | 9.2 | 158 | 1.00 | 79 |

To obtain the data shown in Table 2, the shaped charges were tested in an API 19b Section IV set-up using steel casing coupons having a thickness of 0.50 inch. The steel coupons were positioned adjacent a cement/concrete sheath or layer having a thickness of 0.75 inch, and the cement sheath was adjacent a natural sandstone target (Rock A) having high strength and low porosity. The shaped charges were detonated so that a perforating jet penetrated the steel coupon, the concrete sheath and Rock A, and the perforation tunnel formed in Rock A and productivity ratio were measured according to the API 19b Section Test requirements. The results in Table 2 indicate that increases in target penetration depth are not necessarily equivalent to increases in productivity ratio. On the other hand, the geometry of the perforating tunnel plays an important role in increasing productivity ratio. Notably, samples D-1 and E-1 both showed improvements in productivity ratio over samples A-1 and C-1. Sample F-1 showed no improvements as compared to samples A-1, B-1, and C-1. The results further indicate that the exothermic reaction of Samples D-1 and E-1 creates perforating tunnels, which provide a geometry that is conducive to favorable flow performance, as compared to Samples A-1, B-1, C-1 and F-1.

TABLE 3

| Samples | Average Entrance Hole Diameter (millimeters (mm) | Average Stressed Rock Target Penetration (millimeters (mm)) | Productivity Ratio | Relative Productivity Ratio (%) |
|---|---|---|---|---|
| A-2 | 9.4 | 331 | 1.42 | 100 |
| B-2 | 8.6 | 392 | 1.7 | 120 |
| C-2 | 8.9 | 305 | 1.60 | 113 |
| D-2 | 10.0 | 295 | 1.38 | 97 |
| E-2 | 9.8 | 318 | 1.83 | 129 |
| F-2 | 9.6 | 254 | 1.42 | 100 |

To obtain the data shown in Table 3, the shaped charges were tested in an API 19b Section IV setup using steel coupons having a thickness of 0.5 inch. The steel coupons were positioned adjacent a cement/concrete sheath or layer having a thickness of 0.75 inch, and the cement sheath was adjacent a natural sandstone target (Rock B) having high porosity and lower strength (as compared to Rock A). The shaped charges were detonated so that a perforating jet penetrated the steel coupon, the concrete sheath and Rock A, and the perforation tunnel formed in Rock B and the productivity ratio were measured according to the API 19b Section Test requirements. The results in Table 2 demonstrate that increases in target penetration depth are not necessarily equivalent to increases in productivity ratio. On the other hand, the geometry of the perforating tunnel plays an important role in increasing productivity ratio. Notably, sample E-2 showed improvements in productivity ratio over samples A-2, B-2, and C-2. Sample F-2 showed no improvements over the other samples. As described above in relation to Table 2, the results presented in Table 3 further indicate that the exothermic reaction of Sample E-2 creates perforating tunnels which provide a geometry that is conducive to favorable flow performance compared to samples A2, B2, C2 & F2.

The components of the apparatus illustrated are not limited to the specific embodiments described herein, but rather, features illustrated or described as part of one embodiment can be used on or in conjunction with other embodiments to yield yet a further embodiment. It is intended that the apparatus include such modifications and variations. Further, steps described in the method may be utilized independently and separately from other steps described herein.

While the apparatus and method have been described with reference to specific embodiments, it will be understood by those skilled in the art that various changes may be made and equivalents may be substituted for elements thereof without departing from the scope contemplated. In addition, many modifications may be made to adapt a particular situation or material to the teachings found herein without departing from the essential scope thereof.

In this specification and the claims that follow, reference will be made to a number of terms that have the following meanings. The singular forms "a," "an" and "the" include plural referents unless the context clearly dictates otherwise. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of" Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

Advances in science and technology may make equivalents and substitutions possible that are not now contemplated by reason of the imprecision of language; these variations should be covered by the appended claims. This written description uses examples to disclose the devices, compositions, and methods in accordance with the disclosure, and also to enable any person of ordinary skill in the art to practice these, including making and using any compositions, devices incorporating the compositions, and performing any incorporated manufacturing methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A shaped charge liner having a composition comprising metal powders, the composition comprising:

one or more of an aluminum metal powder and a titanium metal powder, wherein each of the aluminum metal powder and the titanium metal powder comprise a grain size range from 50 micrometers to 150 micrometers;

a bronze metal powder comprising two or more different grain size ranges, the grain size ranges being selected from the ranges comprising 50 micrometers to 150 micrometers, 100 micrometers to 124 micrometers, 125 micrometers to 159 micrometers, 160 micrometers to 179 micrometers, and 180 micrometers to 250 micrometers;

a tungsten metal powder comprising a grain size up to 200 micrometers; and a graphite powder comprising a grain size up to 100 micrometers.

2. The shaped charge liner of claim 1, wherein at least one of the titanium metal powder and the aluminum metal powder is present in an amount up to 10% w/w of the composition.

3. The shaped charge liner of claim 1, wherein the bronze metal powder is present in an amount up to 35% w/w of the composition.

4. The shaped charge liner of claim 1, wherein the bronze metal powder comprises three or more different grain size ranges.

5. The shaped charge liner of claim 1, wherein at least 5% to 15% w/w of the composition is the bronze metal powder comprising a grain size range between 180 micrometers to 250 micrometers, at least 2% to 10% w/w of the composition is the bronze metal powder comprising a grain size range between 160 micrometers to 179 micrometers, and at least 2% to 10% w/w of the composition is the bronze metal powder comprising a grain size range between 125 micrometers to 159 micrometers.

6. The shaped charge liner of claim 1, wherein the tungsten metal powder is present in an amount up to 70% w/w of the composition.

7. The shaped charge liner of claim 1, wherein the composition further comprises a lead metal powder, the lead metal powder comprising one or more of a first grain size range from between 150 micrometers to 300 micrometers and a second grain size of up to 120 micrometers.

8. The shaped charge liner of claim 7, wherein the lead metal powder is present in an amount between 10% w/w and 30% w/w of the composition.

9. The shaped charge liner of claim 1, wherein the aluminum metal powder comprises a grain size range between 50 micrometers and 125 micrometers, and is present in an amount up to 5% w/w of the composition.

10. The shaped charge liner of claim 1, wherein the composition comprises the titanium metal powder in an amount of 5% to 10% w/w of the composition.

11. The shaped charge liner of claim 1, wherein the composition comprises the aluminum metal powder and the titanium metal powder, the aluminum metal powder being present in an amount of less than or equal to 5% w/w of the composition and comprising a grain size range between 50 micrometers and 75 micrometers, and the titanium metal powder being present in an amount of 5% to 10% w/w of the composition.

12. A shaped charge comprising:

a case having a cavity;

an explosive load disposed within the cavity of the case; and a liner disposed adjacent the explosive load and configured for retaining the explosive load within the cavity of the case, the liner having a composition comprising metal powders, the composition comprising:

one or more of an aluminum metal powder and a titanium metal powder, wherein each of the aluminum metal powder and the titanium metal powder comprises a grain size range from 50 micrometers to 150 micrometers;

a bronze metal powder having two or more different grain size ranges, the grain size ranges being selected from the ranges comprising 50 micrometers to 150 micrometers, 100 micrometers to 124 micrometers, 125 micrometers to 159 micrometers, 160 micrometers to 179 micrometers, and 180 micrometers to 250 micrometers;

a tungsten metal powder comprising a grain size up to 200 micrometers; and a graphite powder comprising a grain size up to 100 micrometers.

13. The shaped charge of claim 12, wherein at least one of the titanium metal powder and the aluminum is present in an amount up to 10% w/w of the composition.

14. The shaped charge of claim 12, wherein the bronze metal powder is present in an amount up to 35% w/w of the composition.

15. The shaped charge of claim 12, wherein the bronze metal powder comprises three or more different grain size ranges.

16. The shaped charge of claim 12, wherein the composition comprises the aluminum metal powder and the titanium metal powder, the aluminum metal powder being present in an amount of up to 5% w/w of the composition and having a grain size range between 50 micrometers and 125 micrometers, and the titanium metal powder being present in an amount of 5% to 10% w/w of the composition.

17. The shaped charge of claim 12, wherein the composition further comprises a lead metal powder, the lead metal powder comprising one or more of a first grain size and a second grain size.

18. A method of forming a shaped charge liner, the method comprising the steps of:

providing a composition comprising metal powders, the composition comprising, one or more of an aluminum metal powder and a titanium metal powder, wherein each of the aluminum metal powder and the titanium metal powder comprises a grain size range from 50 micrometers to 150 micrometers, a bronze metal powder having two or more different grain size ranges, the grain size ranges being selected from the ranges comprising 50 micrometers to 150 micrometers, 100 micrometers to 124 micrometers, 125 micrometers to 159 micrometers, 160 micrometers to 179 micrometers, and 180 micrometers to 250 micrometers, a tungsten metal powder having a grain size up to 200 micrometers a graphite powder having a grain size up to 100 micrometers;

mixing the composition to form a homogenous metal powder blend;

forming the homogenous powder blend into a desired liner shape.

19. The method of claim 18, wherein the homogenous powder blend is subjected to one or more of a vibrational and a rotational force.

20. The method of claim 18, wherein the mixing or blending process comprises separately mixing the bronze metal powder having the two or more different grain size ranges, prior to mixing the composition.

* * * * *